United States Patent [19]

Yoshizawa et al.

[11] Patent Number: 4,810,605

[45] Date of Patent: Mar. 7, 1989

[54] ELECTROPHOTOGRAPHIC SUPERLATTICE PHOTORECEPTOR

[75] Inventors: Shuji Yoshizawa; Tatsuya Ikezue, both of Tokyo, Japan

[73] Assignee: Kabushiki Kaisha Toshiba, Kawasaki, Japan

[21] Appl. No.: 114,738

[22] Filed: Oct. 30, 1987

[30] Foreign Application Priority Data

Oct. 31, 1986 [JP] Japan ..... 61-259745
Oct. 31, 1986 [JP] Japan ..... 61-259747

[51] Int. Cl.[4] ..... G03G 5/082; G03G 5/14

[52] U.S. Cl. ..... 430/58; 430/57; 430/65; 430/67; 437/101

[58] Field of Search ..... 430/57, 58, 60, 63, 430/65, 66, 67; 437/101

[56] References Cited

U.S. PATENT DOCUMENTS

| | | | |
|---|---|---|---|
| 4,492,810 | 1/1985 | Ovshinsky et al. | 136/255 |
| 4,632,894 | 12/1986 | Ohashi et al. | 430/84 |
| 4,642,413 | 2/1987 | Ovshinsky et al. | 136/249 |
| 4,672,015 | 6/1987 | Maruyama et al. | 430/57 |
| 4,683,184 | 7/1987 | Osawa et al. | 430/95 |
| 4,683,186 | 7/1987 | Ohashi et al. | 430/84 |
| 4,701,395 | 10/1987 | Wronski | 430/57 X |
| 4,717,637 | 1/1988 | Yoshizawa et al. | 430/66 X |
| 4,718,947 | 1/1988 | Arya | 437/101 X |
| 4,720,444 | 1/1988 | Chen | 430/58 |
| 4,722,879 | 2/1988 | Ueno et al. | 430/57 |
| 4,729,937 | 3/1988 | Yamazaki | 430/65 |

FOREIGN PATENT DOCUMENTS 0066812 12/1982 European Pat. Off. .

OTHER PUBLICATIONS

Gottfried H. Doehler, "Solid-State Superlattices", Scientific American, vol. 249, No. 5, Nov. 1983, pp. 144–151.

*Primary Examiner*—Roland E. Martin
*Attorney, Agent, or Firm*—Foley & Lardner, Schwartz, Jeffery, Schwaab, Mack, Blumenthal & Evans

[57] ABSTRACT

An electrophotographic photoreceptor includes a conductive substrate and a photoconductive layer, provided on the conductive substrate, for generating photocarriers upon light radiation. At least part of the photoconductive layer contains and has a plurality of thin microcrystalline semiconductor layers containing silicon as a major component, and at least one element selected from the group consisting of carbon, oxygen, and nitrogen. The adjacent thin microcrystalline semiconductor layers have different element concentrations. The element concentrations are continuously changed near the interfaces of the thin microcrystalline semiconductor layers.

15 Claims, 6 Drawing Sheets

ELECTROPHOTOGRAPHIC SUPERLATTICE PHOTORECEPTOR

BACKGROUND OF THE INVENTION

The present invention relates to an electrophotographic photoreceptor for use in electrophotography.

Amorphous silicon containing hydrogen H (to be referred to as a-Si:H hereinafter) has received a great deal of attention as a photoconductive material, and has been used in a variety of applications, such as solar cells, thin film transistors, image sensors, and electrophotographic photoreceptors.

The materials used as the photoconductive layers in conventional electrophotographic photoreceptors can be categorized as either inorganic (e.g., CdS, ZnO, Se, or Se-Te) or organic (poly-N-vinylcarbazole (PVCZ) or trinitrofluorene). The a-Si:H has many advantages over the above-mentioned conventional organic and inorganic materials, such as that it is non-toxic and does not require recovery, high spectral sensitivity in the range of visible light is guaranteed, and its high surface hardness ensures high resistance to wear, and good anti-impact properties. For this reason, a-Si:H is receiving a great deal of attention as a promising electrophotographic photoreceptor.

The a-Si:H material has been developed as an electrophotographic photoreceptor on the basis of the Carlson system. In this case, good photoreceptor properties mean high dark resistance and high sensitivity to light. However, it is difficult to incorporate these two properties in a signal layer photoreceptor. A barrier layer is arranged between the photoconductive layer and a conductive support, and a surface charge-retaining layer is formed on the photoconductive layer, to constitute a multilayer structure, thereby satisfying the two requirements described above.

The a-Si:H material for use as a photoreceptor is prepared by glow discharge decomposition, using a silane gas. During the fabrication process, hydrogen is incorporated in the a-Si:H film, whereby the electrical and optical characteristics thereof are changed greatly, according to the change in hydrogen content. As the amount of hydrogen incorporated in the a-Si:H film increases, the film's optical bandgap widens and its resistance increases. Along with the increase in resistance, the sensitivity to long-wavelength light is degraded. Therefore, it is difficult to use such an a-Si:H film in a laser beam printer utilizing a semiconductor laser. When the content of hydrogen in the a-Si:H film is high, as described above, most of the components in the film can have bonding structures, such as those in (SiH2)n and SiH2, depending on film formation conditions. In this case, the number of voids and hence, the number of silicon dangling bonds, increases, thereby degrading the photoconductive characteristics of the film. Under these circumstances, the film cannot be used as an electrophotographic photoreceptor. However, when the content of hydrogen in the a-Si:H film is low, the optical bandgap is narrow and the resistance lower. As a result, the sensitivity to short-wavelength light is increased. A small content of hydrogen causes bonding of hydrogen atoms with he silicon dangling bonds, thus reducing the number of the silicon dangling bonds. For this reason, the mobility of photocarriers is degraded, thereby shortening their lifetime. At the same time, the photoconductive property of the film is degraded and the film cannot be used as an electrophotographic photoreceptor.

SUMMARY OF THE INVENTION

It is an object of the present invention to provide an electrophotographic photoreceptor excellent in charge retaining, dark attenuation, photosensitivity, and environmental resistance properties.

According to a first embodiment of the present invention, there is provided an electrophotographic photoreceptor comprising a conductive substrate and a photoconductive layer disposed on the conductive substrate to generate photocarriers upon light radiation. At least part of the photoconductive layer has a plurality of thin microcrystalline semiconductor layers containing silicon as a major constituent and at least one element selected from the group consisting of carbon, hydrogen, and nitrogen. The adjacent thin microcrystalline semiconductor layers have different element concentrations, and the element concentrations are continuously changed at and near interfaces between the thin microcrystalline semiconductor layers.

In the first embodiment described above, since the element concentrations are continuously changed at and near interfaces of the thin microcrystalline semiconductor layers, continuous film formation can be performed. Therefore, the adhesion property between the thin microcrystalline semiconductor layers can be greatly improved.

According to a second embodiment of the present invention, there is provided an electrophotographic photoreceptor comprising a conductive substrate and a photoconductive layer disposed on the conductive substrate to generate photocarriers upon light radiation. The photoconductive layer comprises a charge-generating layer and a charge-transporting layer. The charge-generating layer comprises a microcrystalline semiconductor containing silicon as a major constituent and at least part of the charge-transporting layer is prepared by alternately stacking a first amorphous semiconductor layer containing silicon as a major constituent and a second amorphous semiconductor layer containing silicon as a major constituent, and at least one element selected from the group consisting of carbon, oxygen, and nitrogen.

An amount of an element selected to be contained in each microcrystalline semiconductor layer of the first embodiment and each second amorphous semiconductor layer of the second embodiment is preferably 0.5 to 30 atomic % and more preferably 5 to 30 atomic %.

The thickness of each microcrystalline semiconductor layer of the first embodiment and the first and second amorphous semiconductor layers of the second embodiment is preferably 30 to 500 Å.

A microcrystalline semiconductor containing silicon as a major constituent, that is, microcrystalline silicon (μc-Si) is thought to be formed by a mixture phase of amorphous silicon and microcrystalline silicon having a particle diameter of several tens of angstrom and has the following physical properties. First, microcrystalline silicon has a diffraction pattern for 2 of 28° to 28.5° according to X-ray diffractiometry and can be clearly distinguished from amorphous Si causing only a halo. Second, a dark resistance of μc-Si can be adjusted to be $10^{10}$ Ω·cm or more and can be clearly distinguished from polycrystalline silicon having a dark resistance of $10^5$ Ωcm.

An optical band gap (Eg) of μc-Si used in the present invention can be arbitrarily set to fall within a predetermined range. The optical band gap is preferably set to be, e.g., 1.55 eV. In this case, in order to obtain a desirble Eg°, hydrogen is preferably added to obtain μc-Si:H.

In the electrophotographic photoreceptor according to the present invention, the content of hydrogen in a-Si:H and μc-Si:H is preferably 0.01 to 30 atomic % and more preferably 1 to 25 atomic %. This amount of hydrogen compensates for dangling bonds of silicon and provides a good balance between the dark resistance and the bright resistance, thereby improving the photoconductive property.

An a-Si:H layer can be formed such that a silane series gas such as $SiH_4$ or $Si_2H_4$ as a raw or source gas is supplied to a reaction chamber and a high-frequency power is supplied to the raw gas to cause glow discharge. In this case, hydrogen or helium gas as a carrier, as needed. However, the material of the source gas is not limited to a silane series gas but can be replaced with a silicon halide gas (e.g., $SiF_4$ or $SiCl_4$) or a mixture of a silane series gas and a silicon halide gas. The a-Si:H layer can be formed not only by the glow discharge method but also by a physical method such as sputtering.

A μc-Si layer can be formed by the high-frequency glow discharge method using silane gas as a raw gas in the same manner as in the a-Si:H layer. In this case, if a film formation temperature is higher than that of the a-Si:H layer, and a high-frequency power for the μc-Si layer is also higher than that of the a-Si:H layer, a μc-Si:H layer is easily formed. Furthermore, when a higher substrate temperature and a higher high-frequency power are used, a flow rate of the raw gas such as silane gas can be increased. As a result, the film formation rate can be increased. Furthermore, when a gas prepared by diluting a silane gas of a higher order (e.g., $SiH_4$ or $Si_2H_6$) with hydrogen is used, a μc-Si:H layer can be formed with higher efficiency.

In order to obtain p-type μc-Si:H and a-Si:H, elements belonging to the Group III of the Periodic Table, such as boron (B), aluminum (Al), gallium (Ga), indium (In), and thallium (Tl) are doped in μc-Si:H and a-Si:H. In order to obtain n-type μc-Si:H and a-Si:H, elements belonging to Group V of the Periodic Table, such as nitrogen (N), phosphorus (P), arsenic (As), antimony (Sb), and bismuth (Bi) are preferably doped in c-Si:H and a-Si:H. Doping of the p- or n-type impurity prevents movement of charges from the substrate to the photoconductive layer. When at least one element selected from the group consisting of carbon (C), nitrogen (N), and oxygen (O) is contained in μc-Si:H and a-Si:H, the resultant layers have a high resistance and a high surface charge retaining capacity.

As described above, in the electrophotographic photoreceptor, at least part of the photoconductive layer is constituted by the plurality of stacked thin layers having different optical band gaps. In this manner, since the thin layers having different optical band gaps are stacked, a superlattice structure can be obtained such that a layer having a larger optical band gap serves as a barrier with respect to a layer having a small optical band gap irrespective of the absolute magnitudes of the optical band gaps so as to constitute a periodic potential barrier pattern. In the superlattice structure, since the layers constituting the barrier are very thin, carriers can pass through the barrier and move in the superlattice structure by the tunnel effect of the carriers in the thin layers. In addition, in such a superlattice structure, a large number of carriers are generated, and they have a long lifetime and a high mobility. For these reasons, the sensitivity of the electrophotographic photoreceptor can be greatly improved. The mechanism for this improvement cannot be perfectly clarified. However, the improvement may be regarded as a quantum effect by a periodic well type potential unique to the superlattice structure. This effect is called a superlattice effect.

By changing the band gap and thickness of the thin layer in the superlattice structure, the apparent band gap may be arbitrarily adjusted.

DETAILED DESCRIPTION OF THE PREFERRED EMBODIMENTS

Various embodiments of the present invention will be described in detail with reference to the accompanying drawings.

Figure 1:
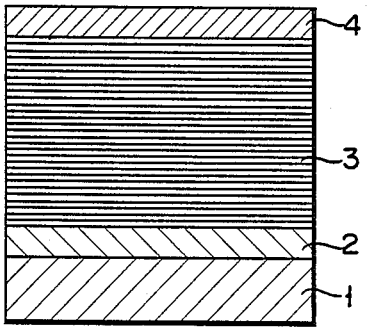
FIG. 1 is a sectional view of an electrophotographic photoreceptor according to a first embodiment of the present invention.
Figure 2:
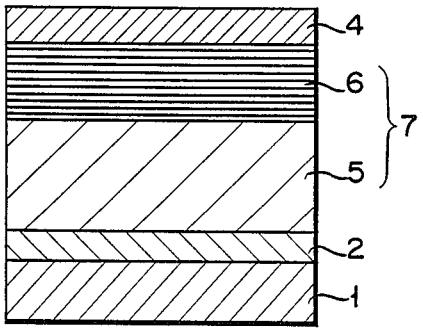
FIG. 2 is a sectional view of an electrophotographic photoreceptor according to another first embodiment of the present invention.

FIGS. 1 and 2 are sectional views of electrophotographic photoreceptors according to a first embodiment of the present invention.

In the electrophotographic photoreceptor shown in FIG. 1, barrier layer 2 is formed on conductive substrate 1, photoconductive layer 3 is formed on barrier layer 2, and surface layer 4 is formed on photoconductive layer 3.

In the electrophotographic photoreceptor shown in FIG. 2, function separating type photoconductive layer 7 comprising charge-transporting layer 5 and charge-generating layer 6 is used. More specifically, charge-transporting layer 5 is formed on barrier layer 2, and charge-generating layer 6 is formed on charge-transporting layer 5. In addition, surface layer 4 is formed on charge-generating layer 6.

The details of the parts in the embodiment shown in FIGS. 1 and 2 are as follows.

Conductive substrate 1 is normally an aluminum drum.

Barrier layer 2 may be formed using μc-Si, a-Si:H, or a-BN:H (nitrogen- or hydrogen-doped amorphous boron). Barrier layer 2 may be made of an insulating film. For example, at least one element selected from the group consisting of carbon (C), nitrogen (N), and oxygen (O) is contained in μc-Si:H or a-Si:H to form an insulating barrier layer having a high resistance. The thickness of barrier layer 2 is preferably 100 A to 10 μm.

Barrier layer 2 restricts a flow of charge between conductive substrate 1 and photoconductive layer 3 (or charge-generating layer 6) to improve a charge-retaining capacity on the surface of the photoconductive layer and to improve a charging capacity of the photoconductive layer. Therefore, when a Carlson photoreceptor is manufactured using a semiconductor layer as a barrier layer, barrier layer 2 must have a p or n conductivity type so as not to degrade the charge-retaining capacity of the surface. More specifically, in order to positively charge the surface of the photoreceptor, p-type barrier layer 2 is formed to prevent injection of electrons for neutralizing the surface charge into the photoconductive layer. However, in order to negatively charge the surface, n-type barrier layer 2 is formed to prevent injection of holes for neutralizing the surface charge into the photoconductive layer. Carriers injected from barrier layer 2 serve as noise for carriers generated in photoconductive layers 3 and 6 upon light radiation. By preventing the carrier injections described above, the sensitivity of the photoconductive layers can be improved. In order to obtain p-type μc-Si:H or p-type a-Si:H, elements belonging to Group III of the Periodic Table, such as boron (B), aluminum (Al), gallium (Ga), indium (In), and thallium (Tl) are preferably doped in μc-Si:H or a-Si:H. In order to obtain n-type μc-Si:H or n-type a-Si:H, elements belonging to Group V of the Periodic Table, such as nitrogen (N), phosphorus (P), arsenic (As), antimony (Sb), and bismuth (Bi) are preferably doped in c-Si:H or a-Si:H.

In the electrophotographic photoreceptor shown in FIG. 1, photoconductive layer 3 generates carriers upon reception of incident light. The carriers having one polarity are neutralized with the charge on the surface of the photoreceptor, and the carriers having the other polarity are moved through photoconductive layer 3 up to conductive substrate 1. In the function separating type photoreceptor shown in FIG. 2, carriers are generated by charge-generating layer 6 upon light incidence. The carriers having one polarity travel in charge-transporting layer 5 and reach conductive substrate 1.

Figure 3:
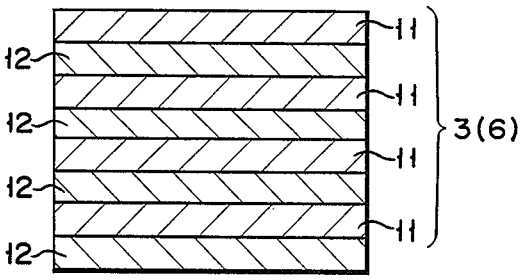
FIG. 3 is a sectional view showing part of FIGS. 1 and 2 in an enlarged scale.

In the embodiment shown in FIGS. 1 and 2, photoconductive layer 3 and charge-generating layer 6 each have a superlattice structure obtained by alternately stacking thin layers 11 and 12, as shown in FIG. 3. At least one element selected from the group consisting of carbon, oxygen, and nitrogen is contained in thin layers 11 and 12. The concentrations of impurities of the thin layers 11 and 12 are different from each other but the concentration curves are continuous at and near the interfaces thereof. The thickness of thin layers 11 and 12 falls within the range of 30 to 500 Å.

Figure 4:
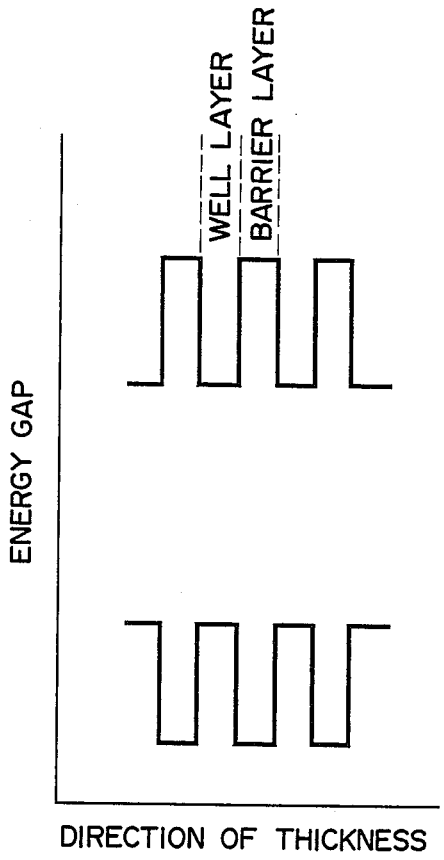
FIGS. 4 and 5 are views respectively showing an energy band of the superlattice structure.
Figure 5:
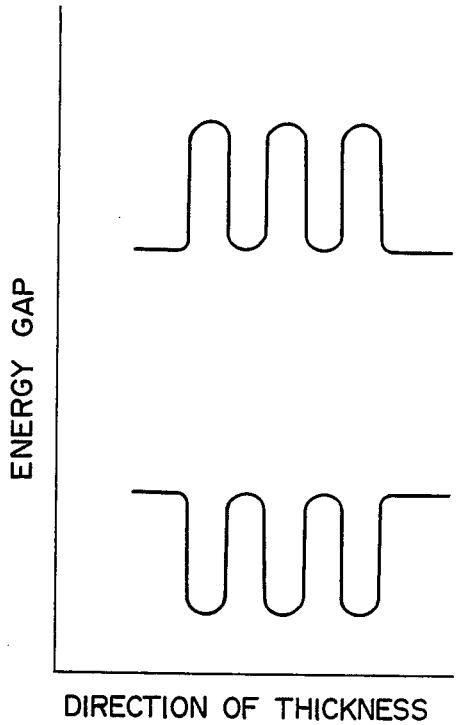

FIGS. 4 and 5 are graphs showing energy bands of the superlattice structure. The direction of thickness is plotted along the ordinate, and the optical band gap is plotted along the abscissa. A superlattice structure (FIG. 4) having a discrete band gap is excellent in carrier generation capacity and mobility. However, in order to form such a superlattice structure, high-frequency power application and gas supply must be interrupted every time a thin film is formed, and the next film formation cannot be performed until the next film formation conditions are satisfied, thus resulting in time loss and poor mass productivity.

In the superlattice structure according to the present invention, however, as shown in FIG. 5, the optical band gaps are continuously changed at and near the interfaces of the thin films. Such a superlattice structure can be obtained by properly changing, a gas flow rate while the high-frequency power is kept constant. According to this film formation method, even if the film formation conditions are changed, the next film formation conditions cannot be immediately set in the reaction chamber. Buffering film formation conditions influenced by the previous film formation conditions are present. As a result, the superlattice structure having optical band gaps shown in FIG. 5 can be obtained. Atomic diffusion occurs at an interface between the adjacent thin layers. This phenomenon can enhance formation of the optical band gap distribution shown in FIG. 5.

By employing the superlattice structure in which concentrations of carbon or the like and therefore optical band gaps are continuously changed at the interfaces of the thin films, the next film formation cycle can be initiated before stable film formation conditions are established. Therefore, the film formation time can be greatly shortened, which contributes to mass production. In addition, since the films can be continuously stacked, a good adhesion property between the thin films can be achieved.

Surface layer 4 is formed on photoconductive layer 3 or charge-generating layer 6. The refractive index of μc-Si:H or a-Si:H constituting photoconductive layer 3 or charge-generating layer 6 is as relatively large as 3 to 3.4, and reflection tends to occur on the surface of the layer. When such reflection occurs, the amount of light to be absorbed in the photoconductive layer or the charge-generating layer is decreased, and optical loss typically occurs. For this reason, surface layer 4 is preferably formed to prevent light reflection. In addition, surface layer 4 prevents photoconductive layer 3 or charge-generating layer 6 from being damaged. Furthermore, the formation of the surface layer allows improvement of the charging capacity, and the surface can be satisfactorily charged. A material of the surface layer is an inorganic compound (e.g., a-SiN:H, a-SiO:H, or a-SiC:H) or an organic material (e.g., polyvinyl chloride or polyamide).

Figure 6:
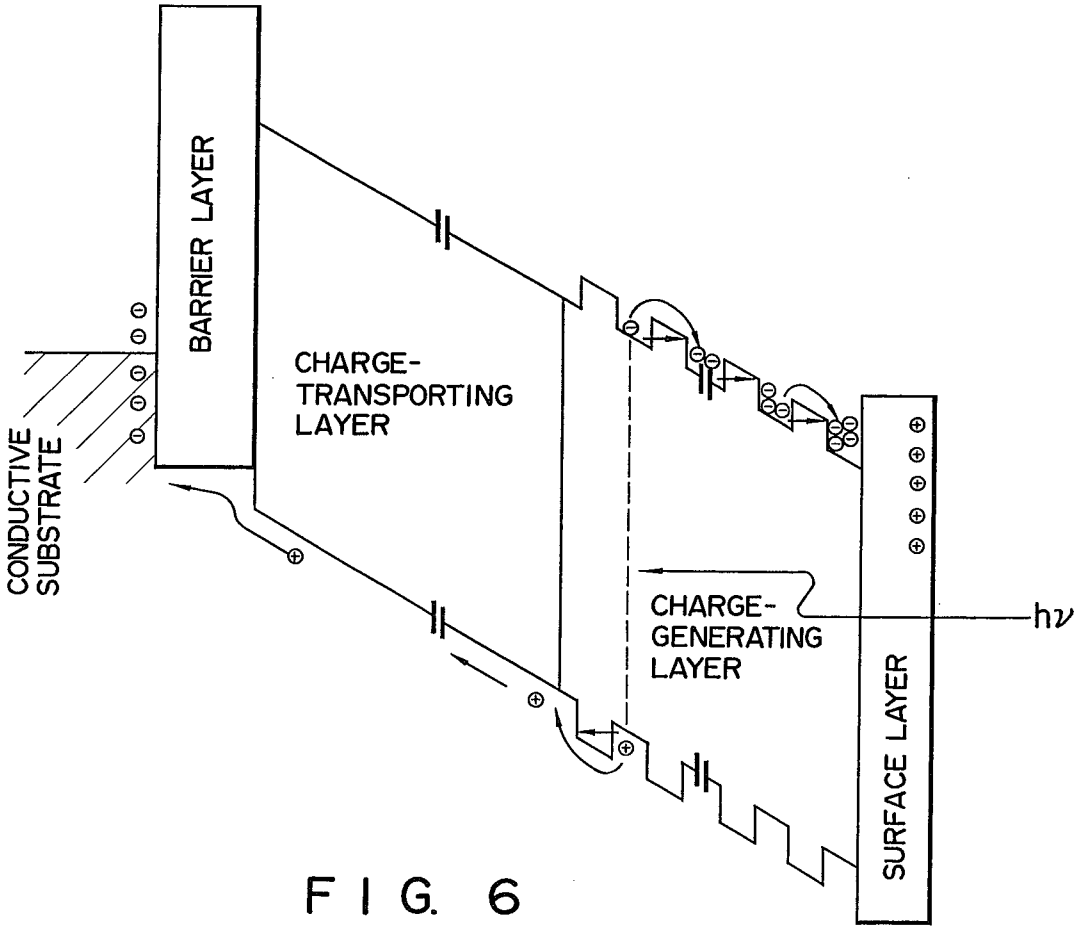
FIG. 6 is a schematic view of an energy gap of a photoreceptor according to the first embodiment of the present invention.

When the surface of the function separating type electrophotographic photoreceptor is positively charged by corona discharge with a voltage of about 500 V, a potential barrier shown in FIG. 6 is formed. When light (hν) is incident on the photoconductive layer, carriers, i.e., electrons and holes, are generated in the superlattice structure of charge-generating layer 6. The electrons in the conduction band are accelerated toward surface layer 4 by an electric field in the photoreceptor, while the holes are accelerated toward conductive substrate 1. In this case, the number of carriers generated at an interface between the adjacent thin layers having different optical band gaps is larger than that generated in the bulk. For this reason, in this superlattice structure, high light sensitivity can be obtained. In the potential well layer, due to the quantum effect, the carrier lifetime is 5 to 10 times that of a single layer which is not a superlattice structure. In addition, in the superlattice structure, discontinuity of the band gaps forms periodic barrier layers. However, the carriers can easily pass through the bias layer by the tunnel effect, so that the effective mobility of the carriers is substantially the same as that in the bulk, thus achieving high-speed carrier movement. As described above, according to the electrophotographic photoreceptor having the charge-generating layer of the superlattice structure wherein thin layers having different optical band gaps are stacked according to the first embodiment, a good photoconductive property can be obtained, and therefore a clearer image can be obtained as compared with a conventional photoreceptor.

Figure 7:
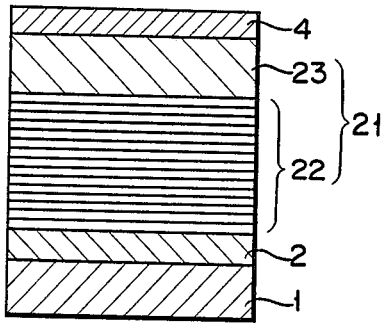
FIG. 7 is a sectional view of an electrophotographic photoreceptor according to a second embodiment of the present invention.
Figure 8:
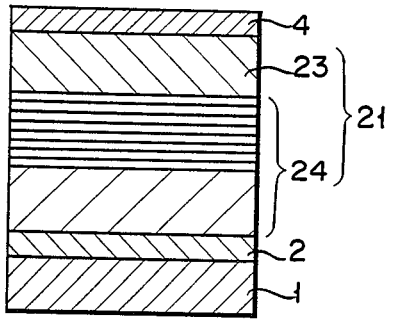
FIG. 8 is a sectional view of an electrophotographic photoreceptor according to another second embodiment of the present invention.

FIGS. 7 and 8 are sectional views of electrophotographic photoreceptors according to a second embodiment of the present invention. The structures of these photoreceptors are the same as that of the first embodiment (FIGS. 1 and 2) except for a photoconductive layer. A description of only the photoconductive layer will be made below.

In the photoreceptor shown in FIG. 7, photoconductive layer 21 comprises charge-transporting layer 22 and charge-generating layer 23. Charge-transporting layer 22 has a superlattice structure.

Charge-generating layer 23 is made of μc-Si. When light is incident on charge-generating layer 23, carriers are generated. The carriers having one polarity are neutralized with the surface charge of the photoreceptor, and the carriers having the other polarity travel in charge-transporting layer 22 and reach conductive substrate 1.

Figure 9:
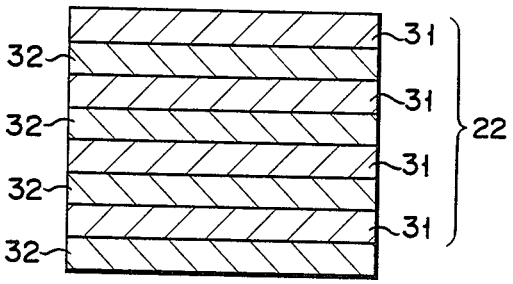
FIG. 9 is a sectional view showing part of FIGS. 7 and 8 in an enlarged scale.

The section of charge-transporting layer 22 is enlarged in FIG. 9, and layer 22 comprises alternately stacked a-Si layers 31 and a-Si layers 32 containing at least one of C, O, and N. Layers 31 and 32 have different optical gaps and each has a thickness of 30 to 500 Å.

In the electrophotographic photoreceptor shown in FIG. 8, part of charge-transporting layer 24 has a superlattice structure.

Figure 10:
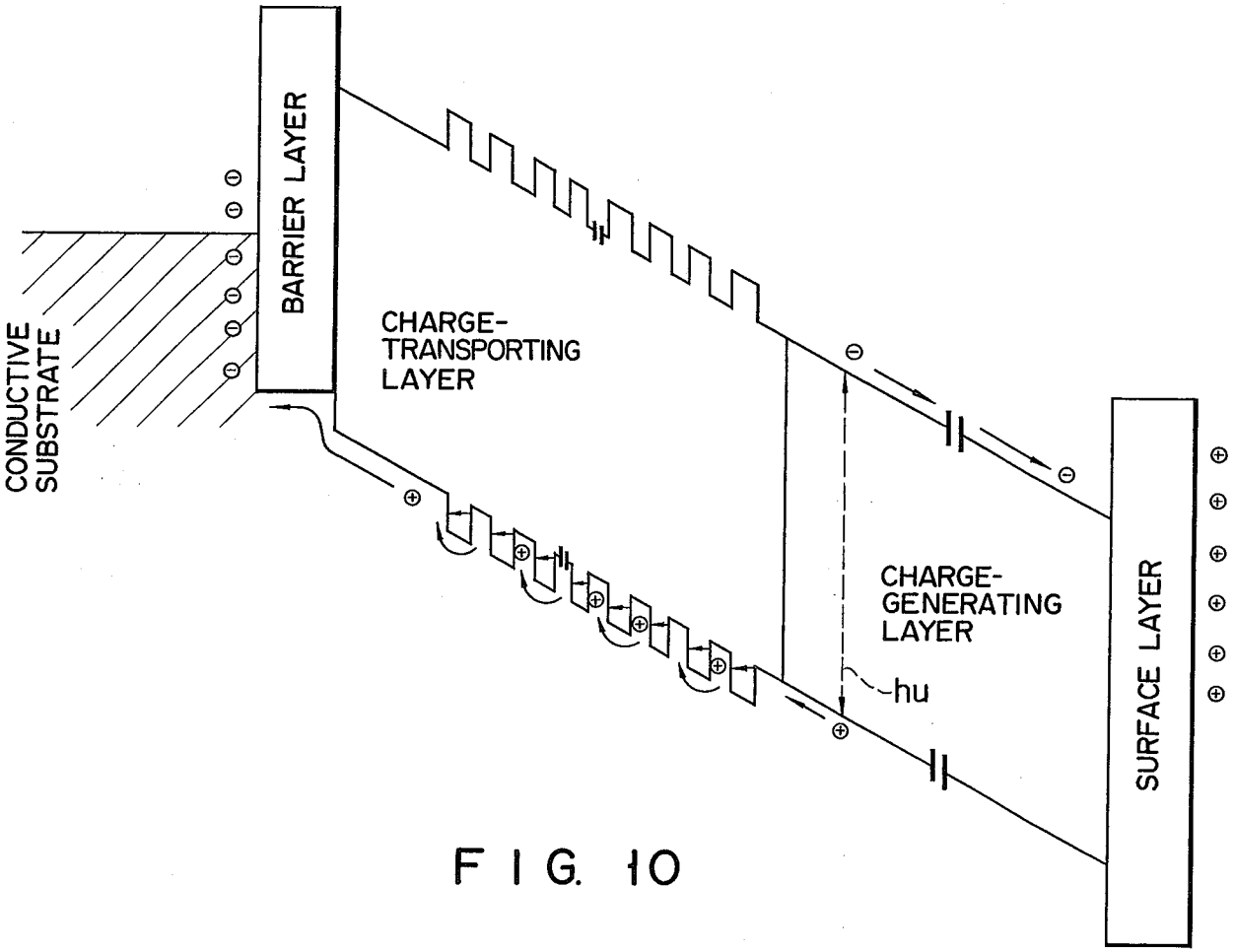
FIG. 10 is a schematic view of an energy gap of a photoreceptor according to the second embodiment of the present invention.

The surface of the photoconductive layer shown in FIGS. 7 and 8 is positively charged by corona discharge with a voltage of about 500 V, and a potential barrier shown in FIG. 10 can be formed. When light (hν) is incident on the photoreceptor, carriers, i.e., electrons and holes, are generated in the superlattice structure of charge-generating layer 23. The electrons in the conduction band are accelerated toward surface layer 4 by an electric field in the photoreceptor, while the holes are accelerated toward conductive substrate 1. In the potential well layer of charge-transporting layer 22, due to the quantum effect, the carrier lifetime is 5 to 10 times that of a single layer which is not a superlattice structure. In addition, in the superlattice structure, discontinuity of the band gaps forms periodic barrier layers. However, the carriers can easily pass through the bias layer by the tunnel effect, so that the effective mobility of the carriers is substantially the same as that in the bulk, thus achieving high-speed carrier movement.

As described above, according to the electrophotographic photoreceptor having the charge-transporting layer of the superlattice structure wherein thin layers having different optical band gaps are stacked according to the second embodiment, a good photoconductive property can be obtained, and therefore a clearer image can be obtained as compared with a conventional photoreceptor.

Figure 11:
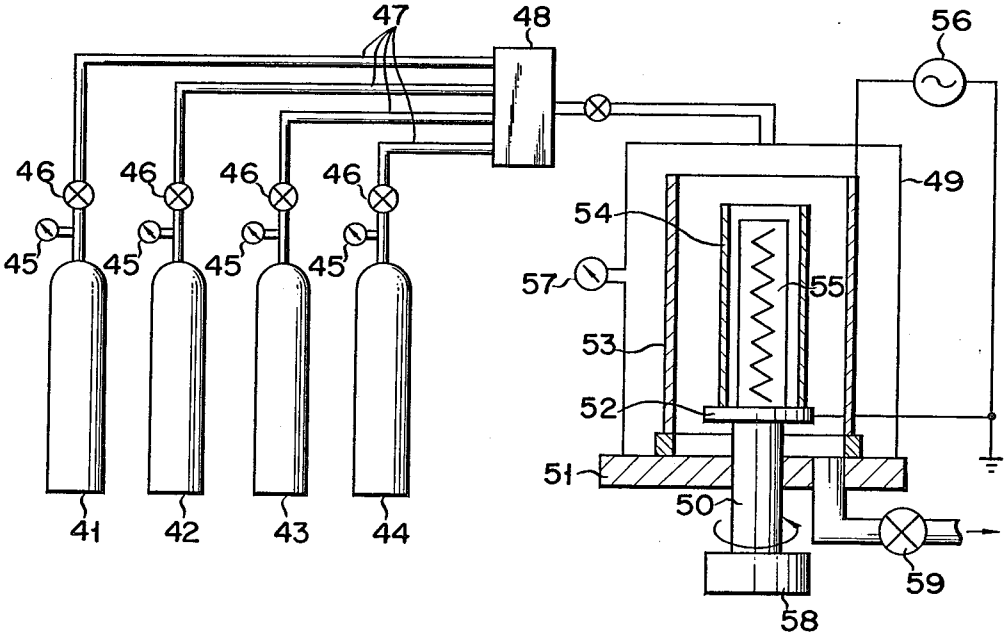
FIG. 11 is a view of an apparatus for manufacturing an electrophotographic photoreceptor of the present invention.

FIG. 11 shows an apparatus for manufacturing an electrophotographic photoreceptor according to the present invention, utilizing the glow discharge method. Gas cylinders 41, 42, 43, and 44 store source gases such as $SiH_4$, $B_2H_6$, $H_2$, and $CH_4$. Gases in cylinders 41, 42, 43, and 44 can be supplied to mixer 48, through flow control valves 46 and pipes 47 respectively. Each cylinder has pressure gauge 45. The operator controls each valve 46 while monitoring corresponding pressure gauge 45, thereby controlling the flow rate of each gas and their mixing ratio. The gas mixture is supplied from mixer 48 to reaction chamber 49. Rotating shaft 10 extends vertically extends from bottom 11 of reaction chamber 49, and can be rotated about the vertical axis. Disk-like support table 52 is fixed on the upper end of shaft 50 such that the surface of table 52 is perpendicular to shaft 50. Cylindrical electrode 53 is arranged inside chamber 49 such a that the axis of electrode 53 is aligned with the axis of shaft 50. Drum-like substrate 54 for a photoreceptor is placed on table 52 such that the axis of the former is aligned with the axis of shaft 50. drum-like substrate heater 55 is arranged inside substrate 54. RF power source 56 is connected between electrode 53 and substrate 54, and supplies an RF current therebetween. Rotating shaft 50 is driven by motor 58. The internal pressure of reaction chamber 49 is monitored by pressure gauge 57, and chamber 49 is connected to a proper evacuating means, such as a vacuum pump, through gate valve 58.

In order to manufacture a photoreceptor in the 5 apparatus having the construction described above, drumlike substrate 14 is placed in reaction chamber 49, and gate valve 59 is opened to evacuate chamber 49 to a vacuum of about 0.1 Torr or less. The predetermined gases from cylinders 41, 42, 43, and 44 are supplied to chamber 49, at a predetermined mixing ratio. In this case, the flow rates of the gases supplied to chamber 49 are determined such that the internal pressure of chamber 49 is set to be 0.1 to 1 Torr. Motor 58 is operated to rotate substrate 54. Substrate 54 is heated to a predetermined temperature by heater 55, and an RF current is supplied between electrode 53 and substrate 14, thereby generating a glow discharge therebetween. An a-Si:H layer is deposited on substrate 54. $N_2O$, $NH_3$, $NO_2$, $N_2$, $CH_4$, $C_2H_4$, and $O_2$ gases and the like may be added to the feed gas to add the element N, C, or O in the a-Si:H layer.

As is apparent from the above description, the electrophotographic photoreceptor according to the present invention can be manufactured in a closed-system manufacturing apparatus, thus guaranteeing the safety of the operators. Since the electrophotographic photoreceptor has high resistance to heat, to humidity, and to wear, repeated use thereof does not result in degradation; thus, a long service life is assured.

Electrophotographic photoreceptors according to the present invention were formed, and their electrophotographic characteristics were tested in the following manner.

EXAMPLE 1

An aluminum drum substrate having a diameter of 80 mm and a length of 350 mm and subjected to acid alkali, and sandblast treatments as needed to prevent interference, was mounted in a reaction chamber, and the interior of the reaction chamber was exhausted by a diffusion pump (not shown) to obtain a vacuum pressure of about $10^{-5}$ Torr. Thereafter, the drum substrate was heated to a temperature of 250° C. and rotated at 10 rpm, and an $SiH_4$ gas with a flow rate of 500 SCCM, a $B_2H_6$ gas with a ratio of flow rate of $10^{-6}$ with respect to the SiH4 gas, and a CH4 gas with a flow rate of 100 SCCM were supplied into the reaction chamber, so that the interior of the reaction chamber was adjusted to be 1 Torr. Then, a high-frequency electric power of 13.56 MHz was applied to an electrode to generate plasma of $SiH_4$, $B_2H_6$, and $CH_4$ between the electrode and the substrate, thereby forming a barrier layer consisting of p-type a-SiC:H.

Then, the $B_2H_6/SiH_4$ ratio was set to be $10^{-7}$, and a high-frequency electric power of 500 W was applied to form a 20-μm charge-transporting layer consisting of i-type a-Si:H.

Thereafter, discharge was temporarily stopped, and the $SiH_4$, $CH_4$, and $H_2$ gases, respectively with flow rates of 100, 2, and 1,000 SCCM were supplied into the reaction chamber to adjust the reaction pressure to be 1.0 Torr. Then, the high-frequency electric power of 1.5 KW was applied to form a 100-A thin μc-SiC:H layer (carbon content: 3 atomic %).

The flow rate of the $CH_4$ gas was increased to 8 SCCM while the high-frequency power was being applied, and a 100-Å thick μC-SiC:H thin layer (carbon concentration: 10 atomic %) was formed. This operation was repeated to alternately form 250 μc-SiC:H thin layers and 250 μc-SiC:H thin layers having different carbon concentrations in the adjacent thin layers, thereby forming 5-μm thick charge-generating layer having a heterojunction superlattice structure. The carbon concentrations near the interfaces of the thin layers were continuously changed.

A 0.5-μm thick a-SiC:H layer was formed as a surface layer.

When the photoreceptor surface thus formed was positively charged at about 500 V and exposed to white light, the light was absorbed in the charge-generating layer, and photocarriers of electron-hole pairs were generated. In this test example, a large number of photocarriers were generated, and a long lifetime and high propagating property of photocarriers were obtained.

As a result, a clear image of high quality was obtained. In addition, when the photoreceptor manufactured in this test example was repeatedly charged, a transferred image was proved to have very good reproducibility and stability and superior durabilities such as high resistance to corona, humidity, and wear. Furthermore, the photoreceptor thus manufactured has a high sensitivity to light having a long wavelength of 780 to 790 nm which is an oscillation wavelength of a semiconductor laser. When the photoreceptor was mounted in a semiconductor laser printer to form an image by the Carlson process, a clear image was obtained with high resolution even when an exposure amount of the photoreceptor was 25 erg/cm$^2$. Note that even when the photoreceptor was exposed to normal light and repeatedly charged as in the case of the white light, a transferred image had good reproducibility and stability and was superior in durability characteristics such as high resistance to corona, humidity, and wear.

EXAMPLE 2

Following the same procedures as in Example 1, a barrier layer of a p-type a-SiC:H and a charge-transporting layer of i-type a-Si:H were formed on an aluminum drum substrate.

$SiH_4$, $H_2$, and $CH_4$ gases were supplied to the reaction chamber at flow rates of 100 SCCM, 1.2 SLM, and 4 SCCM, respectively, and a reaction pressure was controlled to 1.0 Torr. A 1.2-kW high-frequency power was applied to the reaction chamber to form a 100-Å thick μc-SiC:H thin layer (carbon concentration: 4 atomic %). Only the high-frequency power was changed to 800 W, and a 100-Å thick μc-SiC:H thin layer (carbon concentration: 100 atomic %) was formed. The above operations were repeated to alternately form 250 μc-SiC:H thin films and 250 other μc-SiC:H films which had different carbon concentrations to prepare a 5-μm thick charge-generating layer having a heterojunction superlattice structure. The carbon concentrations at the interfaces of the thin layers were continuously changed.

A 0.5-μm thick a-SiC:H thin layer was formed as a surface layer.

The resultant photoreceptor was tested following the same procedures as in Example 1, and similar test results were obtained.

EXAMPLE 3

A photoreceptor layer was formed following the same procedures as in Example 1, except that a barrier layer was a p-type μc-Si:H layer. More specifically, $SiH_4$, $H_2$, and $CH_4$ gases were supplied to the reaction chamber at flow rates of 50 SCCM, 1 SLM, and 2 SCCM, respectively. A $B_2H_6$ gas was supplied at a flow rate ratio of $10^{-2}$ with respect to the $SiH_4$ gas, and the pressure was controlled to 1 Torr. A 1.4-kW high-frequency power was applied to form a 5,000-Å thick μc-SiC:H barrier layer. This thin layer had a crystallinity of 70% and a crystal grain size of 40 Å.

The resultant photoreceptor was tested following the same procedures as in Example 1, and similar test results were obtained.

EXAMPLE 4

Following the same procedures as in Example 1, a barrier layer of p-type a-SiC was formed on an aluminum drum substrate.

High-frequency discharge was temporarily interrupted, an $NH_3$ gas was supplied at a flow rate of 120 SCCM, a reaction pressure was controlled to 1.2 Torr, and a 500-W high-frequency power was applied to ? Z 25 the chamber, thereby forming a 100-Å thick a-SiN:H thin layer. The flow rate of the $SiH_4$ gas was then controlled to 500 SCCM, and $B_2H_6$ was supplied at a flow rate ratio of $10^{-7}$ with respect to the $SiH_4$ gas. A 500-W high-frequency power was applied to the reaction chamber to form a 100-Å thick a-Si:H thin layer. The above operations were repeated to alternately form 750 a-SiN:H thin layers and 750 a-Si:H thin layers to obtain a 1.5 m thick charge-retaining layer having a heterojunction superlattice structure.

Thereafter, $SiH_4$ and $H_2$ gases were supplied to the reaction chamber at flow rates of 150 SCCM and 1,200 SCCM, respectively. The pressure of the reaction chamber was controlled to 1.2 Torr. A 1-kW high-frequency power was applied to form a 5-μm thick i-type c-Si charge-generating layer.

Finally, a 0.5-μm thick a-SiC:H surface layer was formed.

The resultant photoreceptor was tested following the same procedures as in Example 1, and similar test results were obtained.

EXAMPLE 5

An electrographic photoreceptor was manufactured following the same procedures as in Example 4 except that a 100-Å thick a-SiC:H thin layer was used in place of the 100-Å thick a-SiN:H layer. The a-SiC:H layer was formed by setting the flow rate of the $CH_4$ gas at 75 SCCM and the pressure of the reaction chamber at 1.2 Torr, and applying 500-W high-frequency power.

The resultant photoreceptor was tested following the same procedures as in Example 1, and similar test results were obtained.

Note that in the above examples, a thickness of the charge-generating layer was 5 μm, but it is not limited to this value. For example, when the thickness is set to be, e.g., 1 or 3 μm, the photoreceptor can be similarly put to practical use.

Furthermore, the number of types of the thin films are not limited to two as in the above examples, but three or more types of thin layers may be stacked. More specifically, a boundary need only be formed between thin layers having optical bandgaps which are different from each other.

What is claimed is:

1. An electrophotographic photoreceptor comprising a conductive substrate and a photoconductive layer, provided on said conductive substrate, for generating photocarriers upon light radiation, wherein at least part of said photoconductive layer is a superlative structure comprising a plurality of 30 Å to 500 Å thin microcrystalline semiconductor layers containing silicon as a major constituent, and at least one element selected from the group consisting of carbon, oxygen, and nitrogen, the adjacent thin microcrystalline semiconductor layers have different element concentrations, and the element concentrations are continuously changed at and near interfaces of said adjacent thin microcrystalline semiconductor layers.

2. A photoreceptor according to claim 1, wherein the element concentrations of said thin microcrystalline semiconductor layers fall within a range of 0.5 to 30 atomic %.

3. A photoreceptor according to claim 2, wherein the element concentrations of said thin microcrystalline semiconductor layers fall within a range of 5 to 30 atomic %.

4. A photoreceptor according to claim 1, wherein said photoconductive layer comprises an amorphous silicon-hydrogen charge-transporting layer of an amorphous semiconductor, and a charge-generating layer obtained by stacking said thin microcrystalline semiconductor layers.

5. A photoreceptor according to claim 1, wherein said thin microcrystalline semiconductor layers contain hydrogen.

6. A photoreceptor according to claim 1, wherein said photoconductive layer contains an element belonging to Group, III or V of the Periodic Table.

7. A photoreceptor according to claim 1, wherein a barrier layer is formed between said photoconductive layer and said conductive substrate.

8. A photoreceptor according to claim 1, wherein a surface layer is formed on said photoconductive layer.

9. An electrophotographic photoreceptor comprising a conductive substrate and a photoconductive layer, provided on said conductive substrate, for generating photocarriers upon light radiation, wherein said photoconductive layer comprises a charge-generating layer and a charge-transporting layer, said charge-generating layer comprises a microcrystalline semiconductor containing silicon as a major constituent, and at least part of said charge-transporting layer has a superlattice structure formed by alternately forming a first amorphous semiconductor layer containing silicon as a major constituent and a second amorphous semiconductor layer containing silicon as a major constituent, and at least one element selected from the group consisting of carbon, oxygen, and nitrogen wherein said first and second thin amorphous semiconductor layers have a thickness of 30 to 500 Å each.

10. A photoreceptor according to claim 9, wherein an element concentration of said second thin amorphous semiconductor layer falls within a range of 0.5 to 30 atomic %.

11. A photoreceptor according to claim 10, wherein an element concentration of said second thin amorphous semiconductor layer falls within a range of 5 to 30 atomic %.

12. A photoreceptor according to claim 9, wherein said thin first and second amorphous semiconductor layers contain hydrogen.

13. A photoreceptor according to claim 9, wherein said photoconductive layer contains an element belonging to Group III or V of the Periodic Table.

14. A photoreceptor according to claim 9, wherein a barrier layer is formed between said photoconductive layer and said conductive substrate.

15. A photoreceptor according to claim 9, wherein a surface layer is formed on said photoconductive layer.

* * * * *